US006162334A

United States Patent [19]

Ray et al.

[11] Patent Number: 6,162,334

[45] Date of Patent: Dec. 19, 2000

[54] INERT ANODE CONTAINING BASE METAL AND NOBLE METAL USEFUL FOR THE ELECTROLYTIC PRODUCTION OF ALUMINUM

[75] Inventors: Siba P. Ray, Murrysville; Xinghua Liu, Monroeville, both of Pa.

[73] Assignee: Alcoa Inc., Pittsburgh, Pa.

[21] Appl. No.: 09/428,004

[22] Filed: Oct. 27, 1999

Related U.S. Application Data

[63] Continuation-in-part of application No. 09/241,518, Feb. 1, 1999, which is a continuation-in-part of application No. 08/883,061, Jun. 26, 1997, Pat. No. 5,865,980.

[51] Int. Cl.[7] ..... C25B 11/00

[52] U.S. Cl. ..... 204/290.14; 204/290.06; 204/290.08; 204/291; 204/292; 204/293; 204/243.1; 204/247.3; 205/380; 205/385; 205/399; 75/246

[58] Field of Search ..... 204/291, 293, 204/290 R, 247.3, 243.1, 292; 75/246; 205/380, 385, 399

[56] References Cited

U.S. PATENT DOCUMENTS

| | | | |
|---|---|---|---|
| 3,996,117 | 12/1976 | Graham et al. | 204/67 |
| 4,190,516 | 2/1980 | Kajimaya et al. | 204/290 R |
| 4,288,302 | 9/1981 | De Nora et al. | 204/105 |
| 4,290,859 | 9/1981 | Oda et al. | 204/16 |
| 4,302,321 | 11/1981 | DeNora et al. | 204/291 |
| 4,374,050 | 2/1983 | Ray | 252/519 |
| 4,374,761 | 2/1983 | Ray | 252/519 |
| 4,397,729 | 8/1983 | Duruz et al. | 204/243 |
| 4,399,008 | 8/1983 | Ray | 204/67 |
| 4,455,211 | 6/1984 | Ray et al. | 204/293 |
| 4,472,258 | 9/1984 | Secrist et al. | 204/292 |
| 4,552,630 | 11/1985 | Wheeler et al. | 204/67 |
| 4,582,585 | 4/1986 | Ray | 204/243 |
| 4,584,172 | 4/1986 | Ray | 419/34 |
| 4,620,905 | 11/1986 | Tarcy et al. | 204/64 |
| 4,871,437 | 10/1989 | Marschman et al. | 204/291 |
| 4,871,438 | 10/1989 | Marschman et al. | 204/291 |
| 4,960,494 | 10/1990 | Nguyen et al. | 204/67 |
| 5,019,225 | 5/1991 | Darracq et al. | 204/67 |
| 5,137,867 | 8/1992 | Ray et al. | 505/1 |
| 5,254,232 | 10/1993 | Sadoway | 204/243 |
| 5,279,715 | 1/1994 | La Camera et al. | 204/64 |
| 5,284,562 | 2/1994 | Beck et al. | 204/243 |
| 5,378,325 | 1/1995 | Dastolfo, Jr. et al. | 204/66 |
| 5,626,914 | 5/1997 | Ritland et al. | 427/377 |
| 5,794,112 | 8/1998 | Ray et al. | 419/21 |
| 5,865,980 | 2/1999 | Ray et al. | 205/367 |
| 5,938,914 | 8/1999 | Dawless et al. | 205/391 |

*Primary Examiner*—Bruce F. Bell

*Attorney, Agent, or Firm*—Alan G. Towner; Edward L. Levine

[57] ABSTRACT

An inert anode for production of metals such as aluminum is disclosed. The inert anode comprises a base metal selected from Cu and Ag, and at least one noble metal selected from Ag, Pd, Pt, Au, Rh, Ru, Ir and Os. The inert anode may optionally be formed of sintered particles having interior portions containing more base metal than noble metal and exterior portions containing more noble metal than base metal. In a preferred embodiment, the base metal comprises Cu, and the noble metal comprises Ag, Pd or a combination thereof.

46 Claims, 3 Drawing Sheets

INERT ANODE CONTAINING BASE METAL AND NOBLE METAL USEFUL FOR THE ELECTROLYTIC PRODUCTION OF ALUMINUM

CROSS REFERENCE TO RELATED APPLICATIONS

This application is a continuation-in-part of U.S. Ser. No. 09/241,518 filed Feb. 1, 1999, pending which is continuation-in-part of U.S. Ser. No. 08/883,061 filed Jun. 26, 1997, now U.S. Pat. No. 5,865,980 issued Feb. 2, 1999, each of which is incorporated herein by reference.

GOVERNMENT CONTRACT

This invention was made with Government support under Contract No. DE-FC07-98ID13666 awarded by the Department of Energy. The Government has certain rights in this invention.

FIELD OF THE INVENTION

The present invention relates to the electrolytic production of metals such as aluminum. More particularly, the invention relates to the electrolytic reduction of alumina to produce aluminum in a cell having an inert anode comprising a copper or silver base metal and at least one noble metal.

BACKGROUND OF THE INVENTION

The energy and cost efficiency of aluminum smelting can be significantly reduced with the use of inert, non-consumable and dimensionally stable anodes. Replacement of traditional carbon anodes with inert anodes should allow a highly productive cell design to be utilized, thereby reducing capital costs. Significant environmental benefits are also possible because inert anodes produce no $CO_2$ or $CF_4$ emissions. The use of a dimensionally stable inert anode together with a wettable cathode also allows efficient cell designs and a shorter anode-cathode distance, with consequent energy savings.

The most significant challenge to the commercialization of inert anode technology is the anode material. Researchers have been searching for suitable inert anode materials since the early years of the Hall-Heroult process. The anode material must satisfy a number of very difficult conditions. For example, the material must not react with or dissolve to any significant extent in the cryolite electrolyte. It must not react with oxygen or corrode in an oxygen-containing atmosphere. It should be thermally stable at temperatures of about 1,000° C. It must be relatively inexpensive and should have good mechanical strength. It must have high electrical conductivity at the smelting cell operating temperature, e.g., about 950°–970° C., so that the voltage drop at the anode is low. In addition, aluminum produced with the inert anodes should not be contaminated with constituents of the anode material to any appreciable extent.

Some examples of inert anode compositions are provided in U.S. Pat. Nos. 4,374,050, 4,374,761, 4,399,008, 4,455,211, 4,582,585, 4,584,172, 4,620,905, 5,794,112 and 5,865,980, assigned to Aluminum Company of America. These patents are incorporated herein by reference.

SUMMARY OF THE INVENTION

An aspect of the present invention is to provide an inert anode comprising a base metal and at least one noble metal.

The base metal comprises Cu, Ag or alloys thereof. Other metals may be alloyed with the base metal, such as Co, Ni, Fe, Al, Sn and the like. The noble metal comprises at least one metal selected from Ag, Pd, Pt, Au, Rh, Ru, Ir and Os. Preferably, the noble metal comprises Ag, Pd, Pt, Au and/or Rh. More preferably, the noble metal comprises Ag, Pd or a combination of Ag and Pd. Particularly preferred inert anode compositions comprise Cu—Ag, Cu—Pd, Cu—Ag—Pd and Ag—Pd alloys.

In an embodiment of the present invention, the exterior or exposed portions of the inert anode may contain more noble metal than base metal. This can be accomplished, for example, by providing a predominantly noble metal coating over a copper and/or silver anode core, or by sintering particles together which individually contain more base metal inside and more noble metal outside.

The inert anodes of the present invention are particularly useful in producing aluminum, but may also be used to produce other metals such as lead, magnesium, zinc, zirconium, titanium, lithium, calcium and silicon, by electrolytic reduction of an oxide or other salt of the metal.

DETAILED DESCRIPTION

Figure 1:
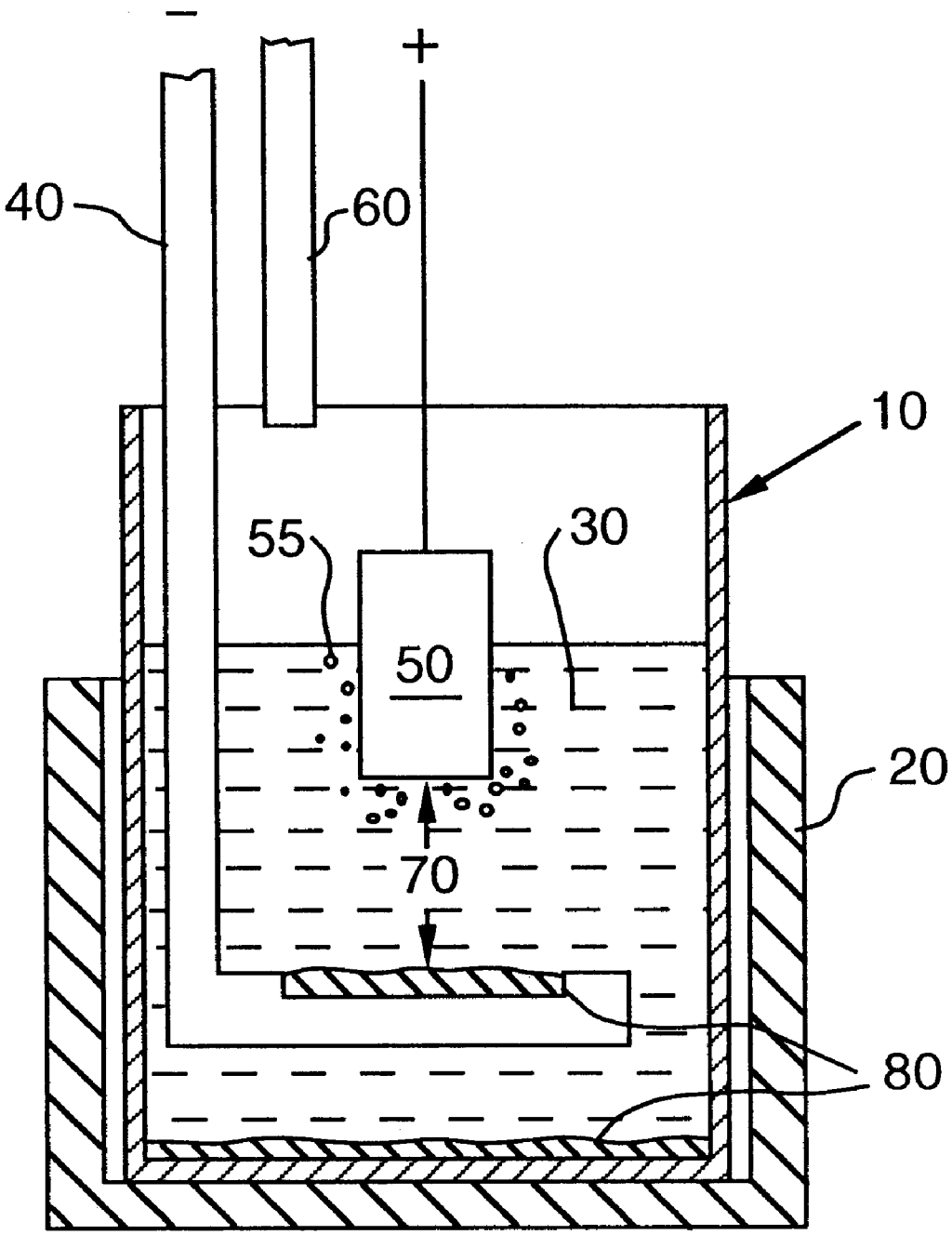
FIG. 1 is a partially schematic sectional view of an electrolytic cell for the production of aluminum including an inert anode in accordance with an embodiment of the present invention.

FIG. 1 schematically illustrates an electrolytic cell for the production of aluminum which includes an inert anode in accordance with an embodiment of the present invention. The cell includes an inner crucible 10 inside a protection crucible 20. A cryolite bath 30 is contained in the inner crucible 10, and a cathode 40 is provided in the bath 30. An inert anode 50 is positioned in the bath 30. An alumina feed tube 60 extends partially into the inner crucible 10 above the bath 30. The cathode 40 and inert anode 50 are separated by a distance 70 known as the anode-cathode distance (ACD). Aluminum 80 produced during a run is deposited on the cathode 40 and on the bottom of the crucible 10.

The inert anodes of the present invention predominantly comprise a base metal and at least one noble metal. Copper and silver are preferred base metals. However, other electrically conductive metals may optionally be used to replace all or part of the copper or silver. Furthermore, additional metals such as Co, Ni, Fe, Al, Sn, Nb, Ta, Cr, Mo, W and the like may be alloyed with the base metal.

The noble metal comprises at least one metal selected from Ag, Pd, Pt, Au, Rh, Ru, Ir and Os, provided that when the base metal is Ag, the noble metal comprises at least one of these metals in addition to Ag. Preferably, the noble metal comprises Ag, Pd, Pt, Ag and/or Rh. More preferably, the noble metal comprises Ag, Pd or a combination thereof As used herein, the term "predominantly" means that the material of the inert anode which is to be submerged in the bath of the electrolytic cell comprises at least 50 weight percent of the combined base metal and noble metal. Preferably, the inert anode comprises at least about 60 weight percent of the combined base metal and noble metal, more preferably at least about 80 weight percent. The presence of such large amounts of base metal/noble metal provides high levels of electrical conductivity through the inert anodes. In a particular embodiment, the inert anode consists essentially of the base and noble metals. The remainder of the inert anode may comprise any other material having satisfactory stability. For example, in addition to the base metal and noble metal, the inert anodes may comprise less than about 50 weight percent ceramic phases such as nickel ferrite, zinc ferrite, iron oxide, nickel oxide and/or zinc oxide. Examples of such ceramics are described in U.S. application Ser. No. 09/241,518, which is incorporated herein by reference. In the case of such cermet materials, the base metal/noble metal materials of the present invention typically form a continuous phase(s) within the inert anode, but in some instances may form a discontinuous phase(s).

The inert anode typically comprises from about 50 to about 99.99 weight percent of the base metal, and from about 0.01 to about 50 weight percent of the noble metal(s). Preferably, the inert anode comprises from about 70 to about 99.95 weight percent of the base metal, and from about 0.05 to about 30 weight percent of the noble metal(s). More preferably, the inert anode comprises from about 90 to about 99.9 weight percent of the base metal, and from about 0.1 to about 10 weight percent of the noble metal(s).

The types and amounts of base and noble metals are selected in order to substantially prevent unwanted corrosion, dissolution or reaction of the inert anodes, and to withstand the high temperatures which the inert anodes are subjected to during the electrolytic metal reduction process. For example, in the electrolytic production of aluminum, the production cell typically operates at sustained smelting temperatures above 800° C., usually at temperatures of 900–980° C. Accordingly, the inert anodes should preferably have melting points above 800° C., more preferably above 900° C., and optimally above about 1,000° C.

Figure 2:
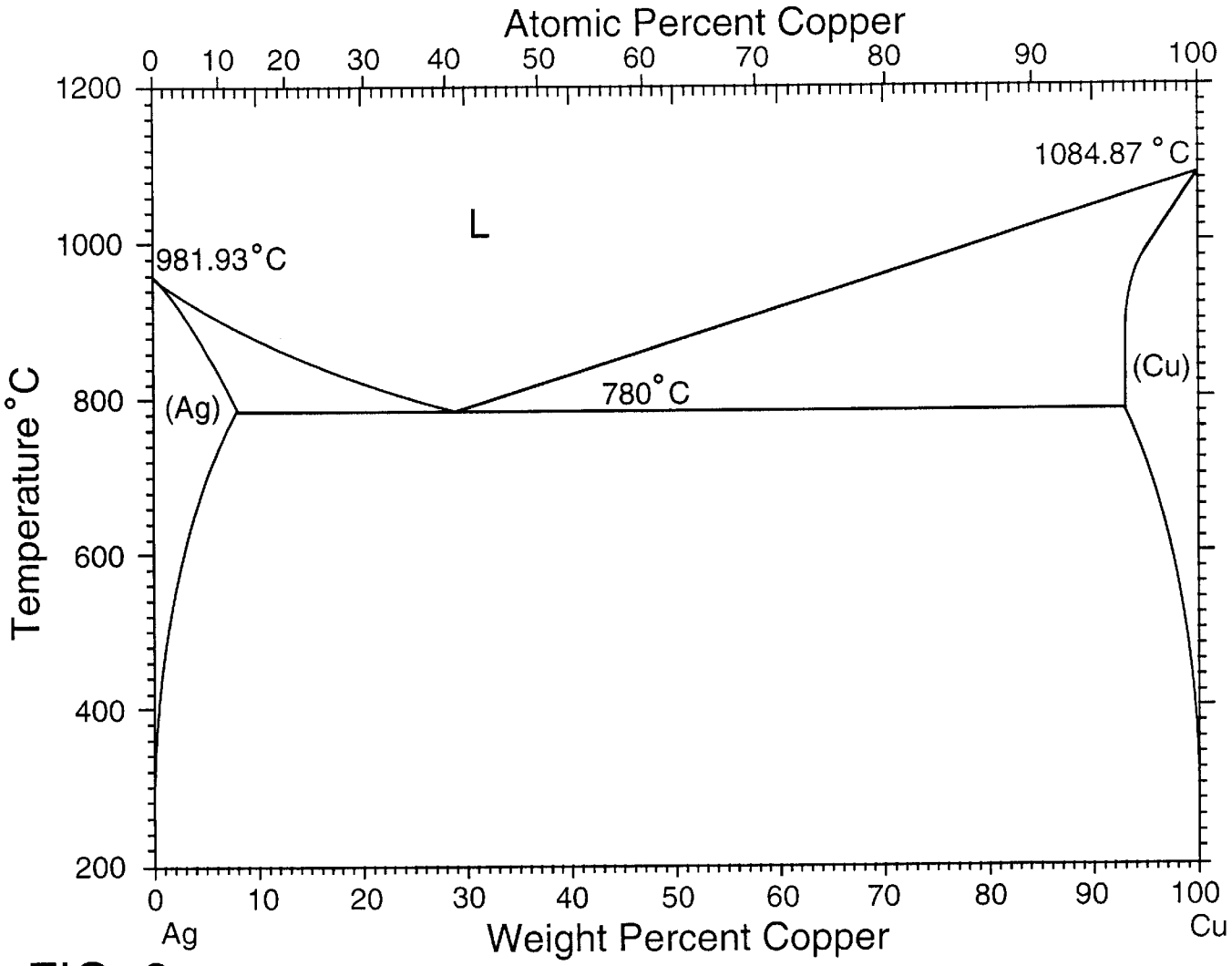
FIG. 2 is a phase diagram for a silver-copper binary alloy.

In one embodiment of the invention, the inert anode comprises copper as the base metal and a relatively small amount of silver as the noble metal. In this embodiment, the silver content is preferably less than about 10 weight percent, more preferably from about 0.2 to about 9 weight percent, and optimally from about 0.5 to about 8 weight percent, remainder copper. By combining such relatively small amounts of Ag with such relatively large amounts of Cu, the melting point of the Cu—Ag alloy is significantly increased. For example, as shown in the Ag—Cu phase diagram of FIG. 2, an alloy comprising 95 weight percent Cu and 5 weight percent Ag has a melting point of approximately 1,000° C., while an alloy comprising 90 weight percent Cu and 10 weight percent Ag forms a eutectic having a melting point of approximately 780° C. This difference in melting points is particularly significant where the alloys are to be used as inert anodes in electrolytic aluminum reduction cells, which typically operate at smelting temperatures of greater than 800° C.

In another embodiment of the invention, the inert anode comprises copper as the base metal and a relatively small amount of palladium as the noble metal. In this embodiment, the Pd content is preferably less than about 20 weight percent, more preferably from about 0.1 to about 10 weight percent.

In a further embodiment of the invention, the inert anode comprises silver as the base metal and a relatively small amount of palladium as the noble metal. In this embodiment, the Pd content is preferably less than about 50 weight percent, more preferably from about 0.1 to about 30 weight percent, and optimally from about 1 to about 20 weight percent.

In another embodiment of the invention, the inert anode comprises Cu, Ag and Pd. In this embodiment, the amounts of Cu, Ag and Pd are preferably selected in order to provide an alloy having a melting point above 800° C., more preferably above 900° C., and optimally above about 1,000° C. The silver content is preferably from about 0.5 to about 30 weight percent, while the Pd content is preferably from about 0.01 to about 10 weight percent. More preferably, the Ag content is from about 1 to about 20 weight percent, and the Pd content is from about 0.1 to about 10 weight percent. The weight ratio of Ag to Pd is preferably from about 2:1 to about 100:1, more preferably from about 5:1 to about 20:1.

In accordance with a preferred embodiment of the present invention, the types and amounts of base and noble metals are selected such that the resultant material forms at least one alloy phase having an increased melting point above the eutectic melting point of the particular alloy system. For example, as discussed above in connection with the binary Cu—Ag alloy system, a minor addition of Ag to Cu results in a substantially increased melting point above the eutectic melting point of the Cu—Ag alloy. Other noble metals, such as Pd and the like, may be added to the binary Cu—Ag alloy system in controlled amounts in order to produce alloys having melting points above the eutectic melting points of the alloy systems. Thus, binary, ternary, quaternary, etc. alloys may be produced in accordance with the present invention having sufficiently high melting points for use as inert anodes in electrolytic metal production cells.

The inert anodes of the present invention may be formed by standard techniques such as powder metallurgy, ingot metallurgy, mechanical alloying and spray forming. Preferably, the inert anodes are formed by powder metallurgical techniques in which powders comprising the individual metal constituents, or powders comprising combinations of the metal constituents, are pressed and sintered. The base metal and noble metal starting powders preferably have average particle sizes of from about 0.1 to about 100 microns. When copper is used as the base metal, it is typically provided in the form of a starting powder having an average particle size of from about 10 to about 40 microns. When silver is used as the base metal or noble metal, it typically has an average particle size of from about 0.5 to about 5 microns. Similarly, when palladium is used as the noble metal, it typically has an average particle size of from about 0.5 to about 5 microns.

Such powders may be mixed, pressed into any desired shape, and sintered to form the inert anode. Pressures of from about 10,000 to about 40,000 psi are usually suitable, with a pressure of about 20,000 psi being particularly suitable for many applications. Sintering temperatures relatively close to the melting point of the particular alloy are preferred, e.g., within 10 or 15° C. of the alloy melting point. During sintering, an inert atmosphere such as argon may be used. The sintered anode may be connected to a suitable electrically conductive support member within an electrolytic metal production cell by means such as welding, brazing, mechanically fastening, cementing and the like.

As an alternative to mixing and consolidating separate base metal and noble metal powders, the base metal powder may be coated with the noble metal(s) prior to pressing and sintering. In this embodiment, the individual particles preferably have an interior portion containing more base metal than noble metal, and an exterior portion containing more noble metal than base metal. For example, the interior portion may contain at least about 60 weight percent copper and less than about 40 weight percent noble metal, while the exterior portion may contain at least about 60 weight percent noble metal and less than about 40 weight percent copper. Preferably, the interior portion contains at least about 90 weight percent copper and less than about 10 weight percent noble metal, while the exterior portion contains less than about 10 weight percent copper and at least about 50 weight percent noble metal. The noble metal coating may be provided by techniques such as electrolytic deposition, electroless deposition, chemical vapor deposition, physical vapor deposition and the like.

Inert anode compositions were made as follows. Metal compositions were prepared by standard powder metallurgy techniques: V-blend for 2 to 4 hours; press at 20 kpsi; sinter at 950 to 1,500° C. in argon for 4 hours. The starting powders included: 10–30 μm (−325 mesh Cu powder; 0.6–1.1 μm Ag powder; 0.1–0.4 μm Pd powder; and 10–30 μm (−325 mesh) Pt powder. The sintered samples were machined to a diameter of 1.0 cm and a length of 4 cm. The compositions are listed below in Table 1.

TABLE 1

| Sample | Metals | Elements (wt-%) | | | | | |
|---|---|---|---|---|---|---|---|
| No. | Alloys | Cu | Ag | Pd | Pt | Ni | Fe |
| 1 | Pt | 0 | 0 | 0 | 100 | 0 | 0 |
| 2 | Cu | 100 | 0 | 0 | 0 | 0 | 0 |
| 3 | Cu3Ag | 96.97 | 3.03 | 0 | 0 | 0 | 0 |
| 4 | Cu6Ag | 93.75 | 6.25 | 0 | 0 | 0 | 0 |
| 5 | Cu6Pt | 93.75 | 0 | 0 | 6.25 | 0 | 0 |
| 6 | Cu6Pd | 93.75 | 0 | 6.25 | 0 | 0 | 0 |
| 7 | Ag10Pd | 0 | 90 | 10 | 0 | 0 | 0 |
| 8 | Cu3Pd | 96.97 | 0 | 3.03 | 0 | 0 | 0 |
| 9 | Cu4.5Ag05.pd | 95 | 4.5 | 0.5 | 0 | 0 | 0 |
| 10 | Cu17Pt | 82.35 | 0 | 17.65 | 0 | 0 | 0 |
| 11 | Cu3.5Ag17Ni1Fe | 78.5 | 3.5 | 0 | 0 | 17 | 1 |
| 12 | Cu4Ag6Ni | 90 | 4 | 0 | 0 | 6 | 0 |
| 13 | Cu3.5Ag4Ni2Fe | 90 | 3.5 | 0 | 0 | 4 | 2 |
| 14 | Cu4Ag6Fe | 90 | 4 | 0 | 0 | 0 | 6 |
| 15 | Ag | 0 | 100 | 0 | 0 | 0 | 0 |
| 16 | Cu3Pt | 96.97 | 0 | 0 | 3.03 | 0 | 0 |
| 17 | Cu17Pt | 82.35 | 0 | 0 | 17.65 | 0 | 0 |

The compositions listed in Table 1 were tested as follows. The samples were mounted in an alumina tube with a tungsten wire as an electrical connector. A molten aluminum pool cathode was electrically connected by a tungsten rod shielded with an alumina tube. The electrolyte was a standard Hall cell bath containing 5 weight percent CaF, saturated alumina (approximately 7 weight percent measured by the Leco technique), and bath ratio (BR) of approximately 1.10 at 960° C.

A cyclic voltammetry (CV) technique was used to evaluate each composition. Cyclic voltammograms were obtained by scanning voltage from zero volts to 2.5V or 3.0V, and back to zero volts. The CV technique yields a corrosion current or current density which corresponds with the corrosion rate of each sample. A high current density indicates a high corrosion rate, while a low current density indicates a low corrosion rate.

Figure 3:
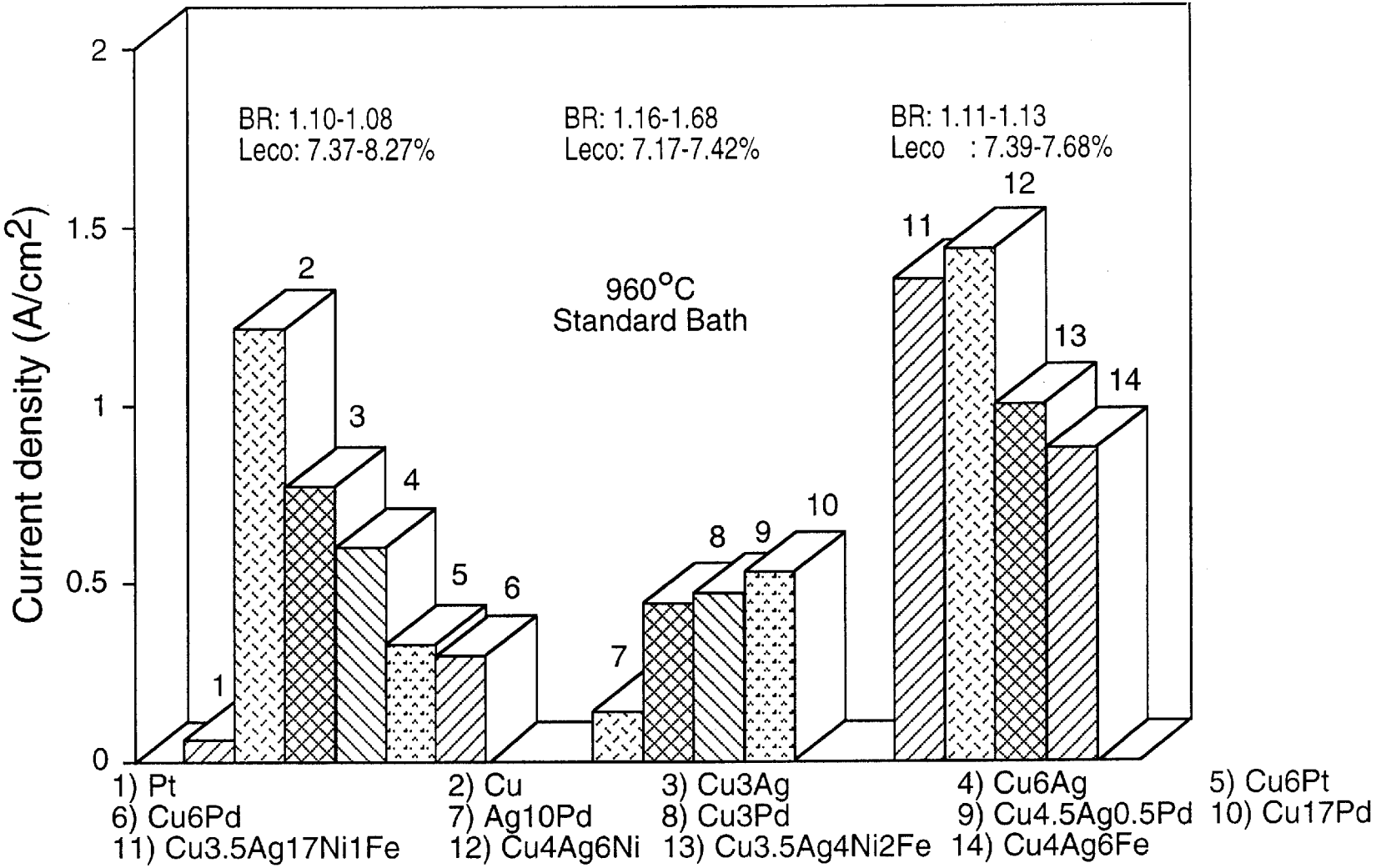
FIG. 3 is a graph illustrating improved corrosion resistance properties exhibited by base metal/noble metal alloys of the present invention.

The results of the corrosion current tests are graphically shown in FIG. 3. As can be seen from FIG. 3, inert anode alloys of the present invention comprising copper base metal and lesser amounts of noble metals exhibit substantially improved corrosion resistance properties. Particularly good corrosion resistance is achieved with the Cu—Ag, Cu—Pd, Cu—Ag—Pd and Ag—Pd alloys.

Inert anodes made in accordance with the present invention are useful in electrolytic cells for aluminum production operated at temperatures in the range of about 800–1,000° C. A particularly preferred cell operates at a temperature of about 900°–980° C., more preferably about 930°–970° C. An electric current is passed between the inert anode and a cathode through a molten salt bath comprising an electrolyte and alumina. In a preferred cell for aluminum production, the electrolyte comprises aluminum fluoride and sodium fluoride. The weight ratio of sodium fluoride to aluminum fluoride is about 0.7 to 1.25, preferably about 1.0 to 1.20. The electrolyte may also contain calcium fluoride and/or lithium fluoride.

While the invention has been described in terms of preferred embodiments, various changes, additions and modifications may be made without departing from the scope of the invention as set forth in the following claims.

What is claimed is:

1. An electrolytic cell for producing metal comprising:

(a) a molten salt bath comprising an electrolyte and an oxide of a metal to be collected;

(b) a cathode; and (c) an inert anode predominantly comprising at least one base metal selected from the group consisting of Cu and Ag, and at least one noble metal selected from the group consisting of Ag, Pd, Pt, Au, Rh, Ru, Ir and Os.

2. The electrolytic cell of claim 1, wherein the base metal comprises Cu, and the at least one noble metal comprises Ag, Pd, Pt, Au, Rh or a combination thereof.

3. The electrolytic cell of claim 2, wherein the at least one noble metal comprises Ag.

4. The electrolytic cell of claim 3, wherein the Ag comprises less than about 10 weight percent of the inert anode.

5. The electrolytic cell of claim 3, wherein the Ag comprises from about 0.2 to about 9 weight percent of the inert anode.

6. The electrolytic cell of claim 3, wherein the Ag comprises from about 0.5 to about 8 weight percent of the inert anode.

7. The electrolytic cell of claim 3, wherein the inert anode has a melting point of greater than 800° C.

8. The electrolytic cell of claim 2, wherein the at least one noble metal comprises Pd.

9. The electrolytic cell of claim 8, wherein the Pd comprises less than about 20 weight percent of the inert anode.

10. The electrolytic cell of claim 8, wherein the Pd comprises from about 0.1 to about 10 weight percent of the inert anode.

11. The electrolytic cell of claim 2, wherein the at least one noble metal comprises Ag and Pd.

12. The electrolytic cell of claim 11, wherein the Ag comprises from about 0.5 to about 30 weight percent of the inert anode, and the Pd comprises from about 0.01 to about 10 weight percent of the inert anode.

13. The electrolytic cell of claim 11, wherein the Ag comprises from about 1 to about 20 weight percent of the inert anode, and the Pd comprises from about 0.1 to about 10 weight percent of the inert anode.

14. The electrolytic cell of claim 11, wherein the weight ratio of Ag to Pd is from about 2:1 to about 100:1.

15. The electrolytic cell of claim 11, wherein the weight ratio of Ag to Pd is from about 5:1 to about 20:1.

16. The electrolytic cell of claim 11, wherein the inert anode has a melting point of greater than 800° C.

17. The electrolytic cell of claim 1, wherein the base metal comprises Ag and the at least one noble metal comprises Pd, Pt, Au, Rh or a combination thereof.

18. The electrolytic cell of claim 17, wherein the noble metal comprises Pd.

19. The electrolytic cell of claim 18, wherein the Pd comprises from about 0.1 to about 30 weight percent of the inert anode.

20. The electrolytic cell of claim 18, wherein the Pd comprises from about 1 to about 20 weight percent of the inert anode.

21. The electrolytic cell of claim 1, wherein the inert anode comprises at least about 60 weight percent of the combined base metal and noble metal.

22. The electrolytic cell of claim 1, wherein the inert anode comprises at least about 80 weight percent of the combined base metal and noble metal.

23. The electrolytic cell of claim 1, wherein the inert anode consists essentially of the at least one base metal and the at least one noble metal.

24. The electrolytic cell of claim 1, wherein the base metal comprises from about 50 to about 99.99 weight percent of the inert anode, and the noble metal comprises from about 0.01 to about 50 weight percent of the inert anode.

25. The electrolytic cell of claim 1, wherein the base metal comprises from about 70 to about 99.95 weight percent of the inert anode, and the noble metal comprises from about 0.05 to about 30 weight percent of the inert anode.

26. The electrolytic cell of claim 1, wherein the inert anode has a melting point of greater than about 800° C.

27. The electrolytic cell of claim 1, wherein the inert anode has a melting point of greater than about 900° C.

28. The electrolytic cell of claim 1, wherein the inert anode has a melting point of greater than about 1,000° C.

29. The electrolytic cell of claim 1, wherein the inert anode comprises an interior portion containing more of the base metal than the noble metal and an exterior portion containing more of the noble metal than the base metal.

30. The electrolytic cell of claim 1, wherein the inert anode comprises sintered particles having an interior portion containing more of the base metal than the noble metal and an exterior portion containing more of the noble metal than the base metal.

31. The electrolytic cell of claim 30, wherein the interior portion contains less than about 40 weight percent of the noble metal and the exterior portion contains less than about 40 weight percent of the base metal.

32. The electrolytic cell of claim 30, wherein the interior portion contains at least about 90 weight percent copper and less than about 10 weight percent of the noble metal and the exterior portion contains less than about 10 weight percent copper and at least about 50 weight percent of the noble metal.

33. The electrolytic cell of claim 1, wherein the inert anode comprises sintered particles having an average particle size of less than about 100 microns.

34. The electrolytic cell of claim 1, wherein the produced metal comprises aluminum.

35. The electrolytic cell of claim 1, wherein the molten salt bath comprises aluminum fluoride and sodium fluoride, and the oxide comprises alumina.

36. An inert anode suitable for use in the production of a metal by electrolytic reduction in a molten salt bath, the anode predominantly comprising at least one base metal selected from the group consisting of Cu and Ag, and at least one noble metal selected from the group consisting of Ag, Pd, Pt, Au, Rh, Ru, Ir and Os.

37. An electrolytic process for producing metal by passing a current between an inert anode and a cathode through a molten salt bath comprising an electrolyte and an oxide of a metal to be collected, the inert anode predominantly comprising at least one base metal selected from the group consisting of Cu and Ag, and at least one noble metal selected from the group consisting of Ag, Pd, Pt, Au, Rh, Ru, Ir and Os.

38. The electrolytic process of claim 37, wherein the produced metal comprises aluminum.

39. The electrolytic process of claim 37, wherein the oxide comprises alumina.

40. The electrolytic process of claim 37, wherein the molten salt bath comprises aluminum fluoride and sodium fluoride, and the oxide comprises alumina.

41. A method of making an inert anode suitable for use in the production of a metal by electrolytic reduction in a molten salt bath, the method comprising:

(a) combining at least one base metal selected from the group consisting of Cu and Ag, and at least one noble metal selected from the group consisting of Ag, Pd, Pt, Au, Rh, Ru, Ir and Os; and (b) forming an inert anode from the at least one base metal and the at least one noble metal which predominantly comprises the at least one base metal and the at least one noble metal.

42. The method of claim 41, wherein the at least one base metal is provided in powder form.

43. The method of claim 42, wherein the at least one noble metal is provided in powder form.

44. The method of claim 42, wherein the at least one noble metal is provided as a coating on the at least one base metal.

45. The method of claim 41, further comprising sintering the combined base metal and noble metal to form the anode.

46. The method of claim 45, wherein the combined base metal and noble metal are sintered at a temperature within 15° C. of a melting point of an alloy formed from the base metal and noble metal.

* * * * *